US005419431A

United States Patent [19]

Neuber et al.

[11] Patent Number: 5,419,431

[45] Date of Patent: May 30, 1995

[54] SEPARABLE CONTAINER FOR STORAGE OF PLURAL ARTICLES

[75] Inventors: Dieter Neuber, Upper Saddle River, N.J.; Larry D. Cobler, Winston-Salem, N.C.; Gerhardt Schubert, Ingersheim, Germany

[73] Assignees: Gerhardt Schubert GmbH, Germany; R. J. Reynolds Tobacco Company; Rodico, Inc.

[21] Appl. No.: 293,277

[22] Filed: Aug. 19, 1994

Related U.S. Application Data

[63] Continuation of Ser. No. 920,801, Jul. 28, 1992, abandoned.

[51] Int. Cl.[6] ..... B65B 85/10; B65B 5/54

[52] U.S. Cl. ..... 206/256; 206/264; 206/273; 229/120.011

[58] Field of Search ..... 206/256, 271, 273, 813, 206/45.22, 264; 229/120.011, 120.11, 120.03, 125.08, 125.19

[56] References Cited

U.S. PATENT DOCUMENTS

| | | | |
|---|---|---|---|
| 739,899 | 8/1854 | Fontana . | |
| 1,028,069 | 5/1912 | Hignett . | |
| 1,318,124 | 10/1919 | Wright . | |
| 2,046,484 | 7/1936 | Ringler . | |
| 2,605,897 | 8/1952 | Rundle . | |
| 2,783,929 | 3/1957 | Delaney . | |
| 2,888,132 | 5/1959 | Guyer . | |
| 3,048,321 | 8/1962 | Sanford . | |
| 3,051,305 | 8/1962 | Houle . | |
| 3,063,553 | 11/1962 | Nicholson . | |
| 3,071,244 | 1/1963 | Doran . | |
| 3,082,929 | 3/1963 | Aquino et al. . | |
| 3,086,650 | 4/1963 | Chapman et al. . | |
| 3,092,301 | 6/1963 | Selle . | |
| 3,113,673 | 12/1963 | Stein . | |
| 3,114,474 | 12/1963 | Davis . | |
| 3,163,351 | 12/1964 | Borgardt . | |
| 3,226,010 | 12/1965 | Rogers, Jr. . | |
| 3,414,182 | 12/1968 | Fobiano . | |
| 3,536,246 | 10/1970 | Rosen . | |
| 3,596,758 | 8/1971 | Phillips, Jr. et al. . | |
| 3,721,335 | 3/1973 | Grant . | |
| 3,752,308 | 8/1973 | Begemann . | |
| 3,809,227 | 5/1974 | Begemann . | |
| 4,083,879 | 4/1978 | Capo . | |
| 4,186,846 | 2/1980 | Jacalone et al. | 229/120.11 X |
| 4,191,288 | 3/1980 | Hostad | 206/45.22 |
| 4,377,237 | 3/1983 | Pawlowski . | |
| 4,631,900 | 12/1986 | Mattei et al. . | |
| 4,712,688 | 12/1987 | Lambert . | |
| 4,738,359 | 4/1988 | Phillips, Jr. . | |
| 4,742,917 | 5/1988 | Bornwasser et al. | 229/120.03 X |
| 4,773,531 | 9/1988 | Tudor et al. . | |
| 4,826,016 | 5/1989 | Foster | 229/120.03 X |
| 4,928,817 | 5/1990 | Focke . | |
| 4,932,534 | 6/1990 | Focke et al. . | |
| 5,038,940 | 8/1991 | Okabe | 229/120.011 |
| 5,058,363 | 10/1991 | Focke et al. . | |
| 5,141,106 | 8/1992 | Adams et al. . | |
| 5,143,213 | 9/1992 | Moore et al. . | |
| 5,147,037 | 9/1992 | Evers et al. . | |
| 5,158,178 | 10/1992 | Cobler . | |
| 5,160,023 | 11/1992 | Adams et al. . | |
| 5,174,443 | 12/1992 | Chance et al. . | |
| 5,174,444 | 12/1992 | Adams et al. . | |
| 5,178,268 | 1/1993 | Talley et al. . | |
| 5,178,269 | 1/1993 | Evers . | |
| 5,178,270 | 1/1993 | Adams et al. . | |
| 5,178,271 | 1/1993 | Adams et al. . | |
| 5,180,055 | 1/1993 | Chance et al. . | |
| 5,180,056 | 1/1993 | Adams et al. . | |
| 5,181,607 | 1/1993 | Focke et al. . | |
| 5,193,674 | 3/1993 | Cobler | 206/256 |
| 5,205,403 | 4/1993 | DeBlasio . | |

*Primary Examiner*—Jacob K. Ackun

*Attorney, Agent, or Firm*—Lerner, David, Littenberg, Krumholz & Mentlik

[57] ABSTRACT

A separable container for storing a plurality of articles is formed from a pair of partially enclosed members arranged in adjacent relationship. A third member is secured to the first and second members so as to form with the first member a first walled enclosure and with the second member a second walled enclosure, each for storing a plurality of articles. A line of perforations arranged in association with the third member enables separating the first and second walled enclosures from each other. The separable container is particularly advantageous in enabling a retailer to sell less than a total quantity of stored articles within the original container, such as cigarette packs and the like.

11 Claims, 6 Drawing Sheets

SEPARABLE CONTAINER FOR STORAGE OF PLURAL ARTICLES

This is a continuation of application Ser. No. 07/920,801 filed Jul. 28, 1992, now abandoned.

BACKGROUND OF THE INVENTION

The present invention relates in general to containers for the storage of miscellaneous plural articles, and more specifically, to cigarette cartons which may be separated into two or more individual cartons, if desired, each storing less than the total quantity of cigarette packs.

Storage and/or package-type containers, e.g., cigarette cartons and the like, are generally constructed from a blank of suitable material folded into the appropriate shape of the desired container. These containers enable the convenient purchase of packaged articles in multiple quantities within a single container. However, when it is desired to purchase less than the entire quantity of packaged articles, there are no suitable means to achieve this objective using the original container. It therefore becomes necessary to obtain a second container for the lesser quantity of articles being sold which, at the same time, results in occupying greater storage space than would otherwise be necessary.

There is known from Focke et al., U.S. Pat. No. 4,932,534, a cigarette carton which is separable into a pair of cartons of like size, each containing an equal number of cigarette packs. The overall cigarette carton is formed from a blank which is folded in such a manner to form a pair of smaller cigarette cartons arranged back to back. The pair of cartons are connected along one edge by a folded portion of the blank which extends to form a face wall of each carton, which are arranged overlying each other. The cartons are maintained together in this relationship by suitable adhesive provided on the face wall, which is interrupted when severing the cartons, one from the other.

The Focke et al. cigarette carton, although enabling the retailing of less than the entire quantity of cigarette packs, suffers from a number of disadvantages. For example, the blank by forming two complete cartons, requires substantially more material than would otherwise be required of a conventional cigarette carton, thereby increasing the costs involved. Further, the Focke et al. cigarette carton has the two cartons hinged together along one edge by a fold line formed in the blank, and maintained in a closed position by the use of an adhesive. In the event that the adhesive should rupture during shipment or handling, the two cartons would partially separate, but for the connecting fold line, rendering the cigarette carton less desirable for retailing and more difficult for handling by the retailer. Accordingly, there is an unsolved need for a separable cigarette carton which is commercially viable.

SUMMARY OF THE INVENTION

The separable container of the present invention will have particular beneficial use in the cigarette packaging industry. It is standard practice in the cigarette industry to package ten cigarette packs per carton. Although carton sizes vary, the ten pack carton is common to all major cigarette manufacturers. Due to the ever increasing cost of a ten pack carton of cigarettes, there is the need in the marketplace for the end retail to be able to sell a five pack carton of cigarettes.

It is broadly an object of the present invention to provide a separable container for the storage of plural articles, in particular, cigarette packs and the like.

Another object of the present invention is to provide a separable container for the storage of plural articles which is constructed from a number of sheets of suitable material which can be folded into the appropriate shape of the desired container.

Another object of the present invention is to provide a cigarette carton for ten packs of cigarettes which enables the retailer the ability to separate the carton into two five pack cartons or the like.

Another object of the present invention is to provide a cigarette carton formed from a number of sheets which can be easily set up into a carton and filled with cigarette packs.

In accordance with one embodiment of the present invention, there is disclosed a container for storing a plurality of articles, the container constructed from partially enclosed first and second members arranged in adjacent relationship, a third member secured to the first and second members, the third member forming with the first member a first walled enclosure and forming with the second member a second walled enclosure each for storing a plurality of articles, and separating means in association with the third member for separating the first walled enclosure from the second walled enclosure.

In accordance with another embodiment of the present invention, there is disclosed a cigarette carton for storing a plurality of cigarette packs, the carton constructed of partially enclosed first and second members arranged in adjacent relationship, a third member secured to the first and second members, the third member forming with the first member a first walled enclosure and forming with the second member a second walled enclosure each for storing a plurality of articles, the first and second members forming bottom walls and spaced apart end walls of the first and second walled enclosures, the third member forming top walls, front walls and rear walls of the first and second walled enclosures and separating means in association with the third member for separating the first walled enclosure from the second walled enclosure.

In accordance with another embodiment of the present invention, there is disclosed a plurality of sheets for forming a container for storing a plurality of articles, the sheets constructed of a first sheet having means for forming the first sheet into a partially enclosed first member, a second sheet into a partially enclosed second member, and a third sheet having means for forming portions of the third sheet with the first member to form a first walled enclosure and forming portions of the third sheet with the second member to form a second walled enclosure each for storing a plurality of articles, the third sheet including separating means for separating the first walled enclosure from the second walled enclosure.

BRIEF DESCRIPTION OF THE DRAWINGS

The above description, as well as further objects, features and advantages of the present invention will be more fully understood with reference to the following detailed description of a separable container for storage of plural articles, when taken in conjunction with the accompanying drawings, wherein.

DETAILED DESCRIPTION

Figure 1:
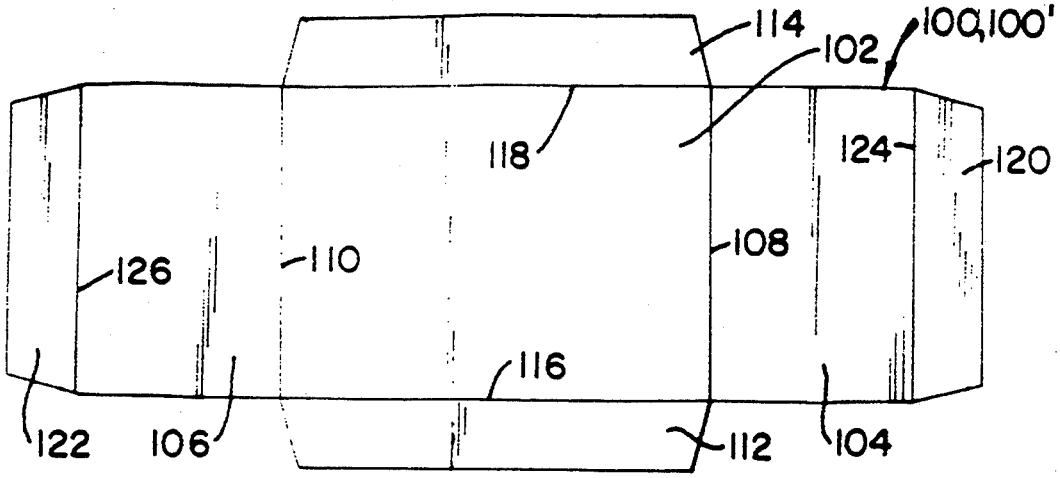
FIG. 1 is a top plan view of a sheet of substantially rigid or semi-rigid, self-supporting material being die cut and provided with fold lines for forming partially enclosed members in accordance with the present invention.

Referring to the drawings, wherein like reference numerals represent like elements, there is disclosed in FIG. 1 a unitary sheet 100 of substantially rigid or semi-rigid, self-supporting material, such as stiff paper, cardboard-like material and the like. A preferred material is 0.12 gauge paper board. The sheet 100 has been cut, conventionally by cold die cutting, so as to be formable into a partially enclosed member for receiving a plurality of articles such as cigarette packs as to be described hereinafter. Specifically, the sheet 100 includes a bottom wall 102 and a pair of spaced apart end walls 104, 106. The end walls 104, 106 are integrally joined on either side of the bottom wall 102 by means of a pair of parallel spaced fold lines 108, 110. A pair of side flaps 112, 114 are integrally joined to the sides of the bottom wall 102 along respective parallel spaced fold lines 116, 118. Finally, a pair of end flaps 120, 122 are integrally joined to the end walls 104, 106 along respective parallel spaced fold lines 124, 126.

Figure 2:
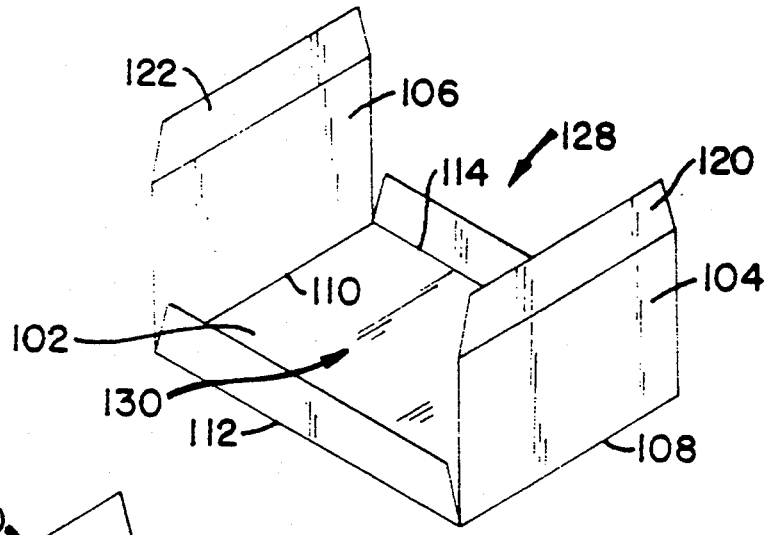
FIG. 2 is a perspective view of a partially enclosed first member formed from the sheet of FIG. 1.

Referring to FIG. 2, the sheet 100 has been folded into the shape of a partially enclosed first member generally designated by reference numeral 128. Initially, the sheet 100 is folded in a common direction about the fold lines 108, 110, 116, 118 to assume a U-shape. The end flaps 120, 122 are maintained unfolded in a common plane with their respective end walls 104, 106. The partially enclosed first member 128 provides an open receiving cavity 130 for storing a plurality of articles such as cigarette packs 132 as shown in FIG. 4.

Figure 3:
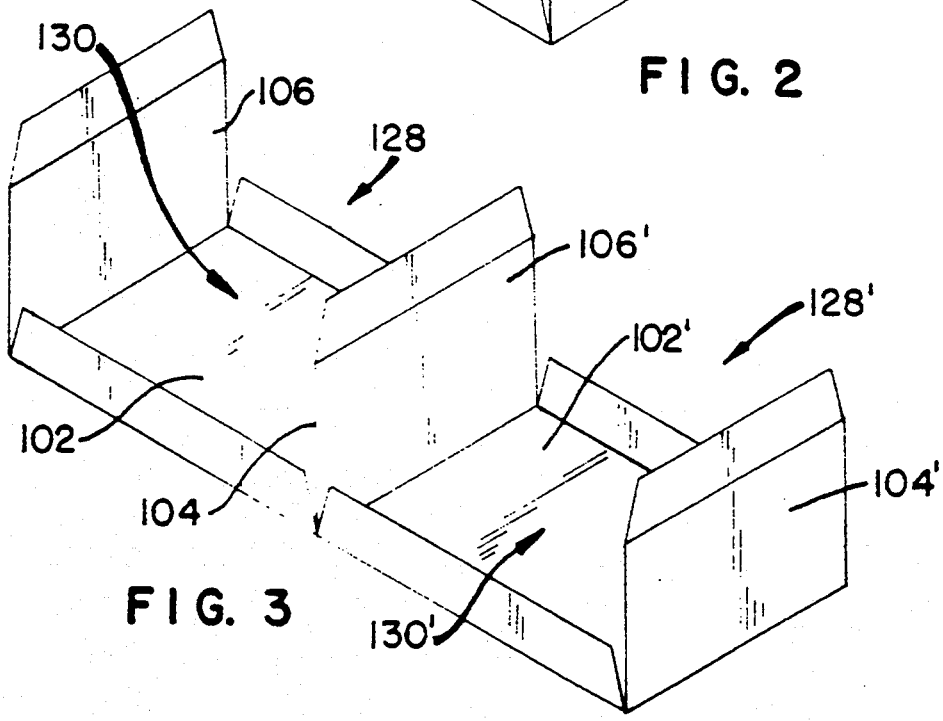
FIG. 3 is a perspective view of partially enclosed first and second members arranged in adjacent relationship formed from a pair of sheets as shown in FIG. 1.
Figure 4:
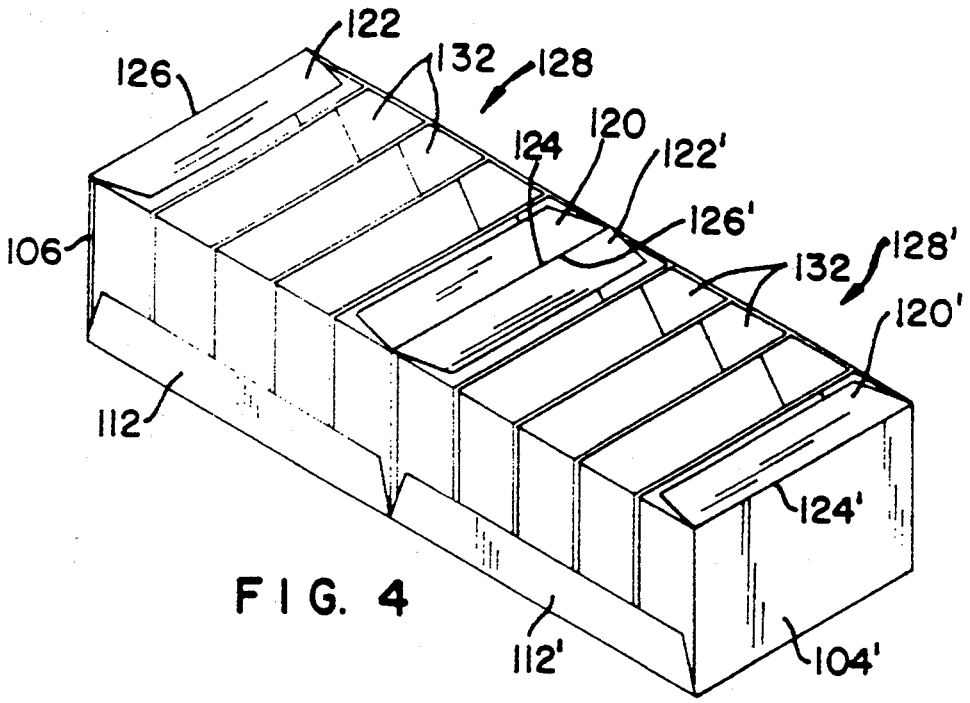
FIG. 4 is a perspective view of the partially enclosed first and second members as shown in FIG. 3 in the nature of a cigarette carton having a plurality of cigarette packs received therein.

Referring to FIG. 3, a partially enclosed second member 128' is formed from a sheet 100' as shown in FIG. 1 and provides a receiving cavity 130' for a plurality of cigarette packs 132 as also shown in FIG. 4. As thus far described, it should be understood that the partially enclosed first and second members 128, 128' are of identical construction by being formed from two identical sheets 100, 100'. The partially enclosed first and second members 128, 128' are arranged adjacent each other in end-to-end relationship. Specifically, the end wall 104 of partially enclosed first member 128 is arranged abutting in overlying relationship with the end wall 106' of the partially enclosed second member 128'. If desired, a suitable adhesive having a relatively weak bond strength may be provided between the end walls 104, 106' to initially maintain the partially enclosed first and second members 128, 128' in their adjacent relationship as shown, while enabling their separation as to be described hereinafter.

Referring to FIG. 4, a plurality of cigarette packs 132 are received within the receiving cavities 130, 130' five packs within the partially enclosed first member 128 and five packs within the partially enclosed second member 128'. The end flaps 122, 120' of respective partially enclosed first and second members 128, 128' are folded inwardly about their respective fold lines 126, 124' to a position overlying the side surface of an adjacent cigarette pack 132. Similarly, the end flaps 120, 122' of respective partially enclosed first and second members 128, 128' are folded outwardly about their respective fold lines 124, 126' to a position overlying a side surface of an adjacent cigarette pack 132 The end flaps 120, 120', 122, 122' and side flaps 112, 112' provide adhesive bonding regions as to be described hereinafter in completing the construction of the separable container in accordance with the present invention.

Figure 5:
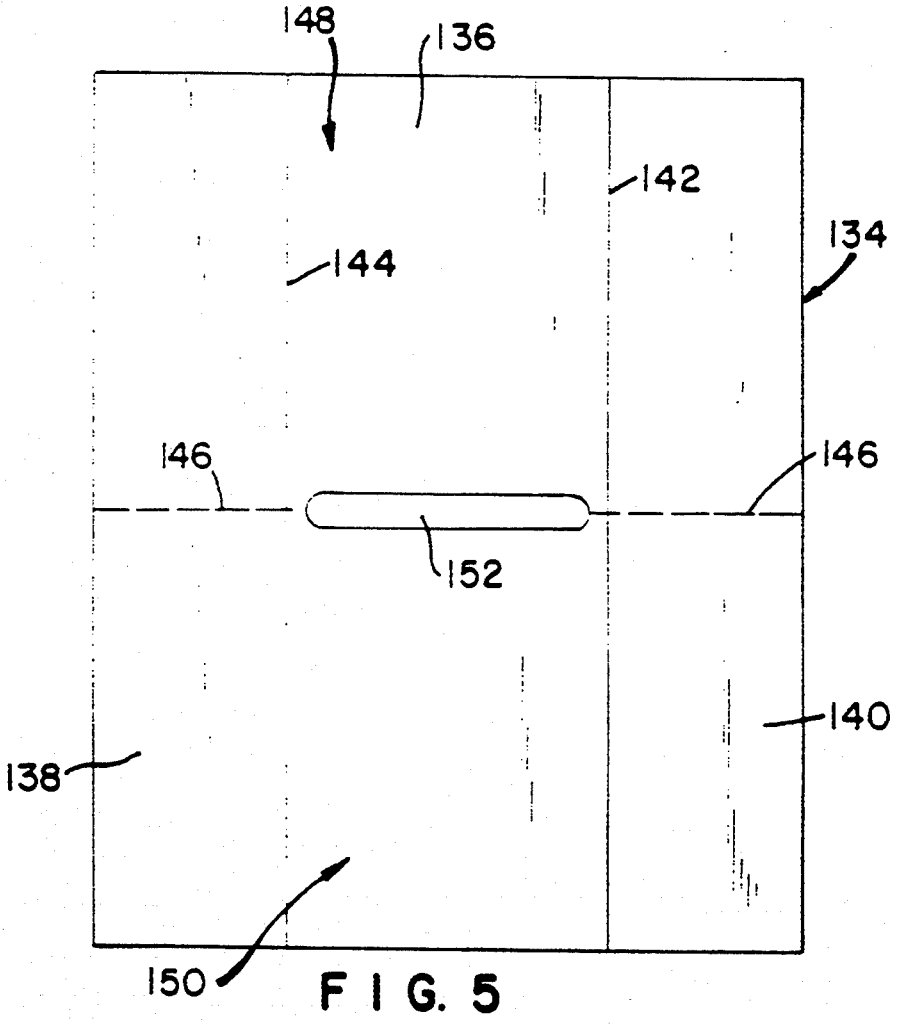
FIG. 5 is a top plan view of a sheet of substantially rigid or semi-rigid, self-supporting material being die cut and provided with fold lines for forming a third member in accordance with the present invention.

Referring to FIG. 5, there is shown a unitary sheet 134 of substantially rigid or semi-rigid, self-supporting material, such as stiff paper, cardboard-like material and the like having a generally rectangular shape. The sheet 134 is divided into three panels which form a top wall 136 and spaced apart front and rear walls 138, 140 when assembled with the partially enclosed first and second member 128, 128'. The front and rear walls 138, 140 are integrally joined to the top wall 136 by means of a pair of parallel spaced apart fold lines 142, 144. A line of perforations 146 is formed transversely across the sheet 134 so as to divide the top wall 136, front wall 138 and rear wall 140 into an upper section 148 and a lower section 150 which may be of equal size and symmetrical with each other as shown in accordance with one embodiment. The perforations 146 may optionally be interrupted within, for example, the top wall 136 by means of an elongated opening 152 for the purposes to be described hereinafter.

Figure 6:
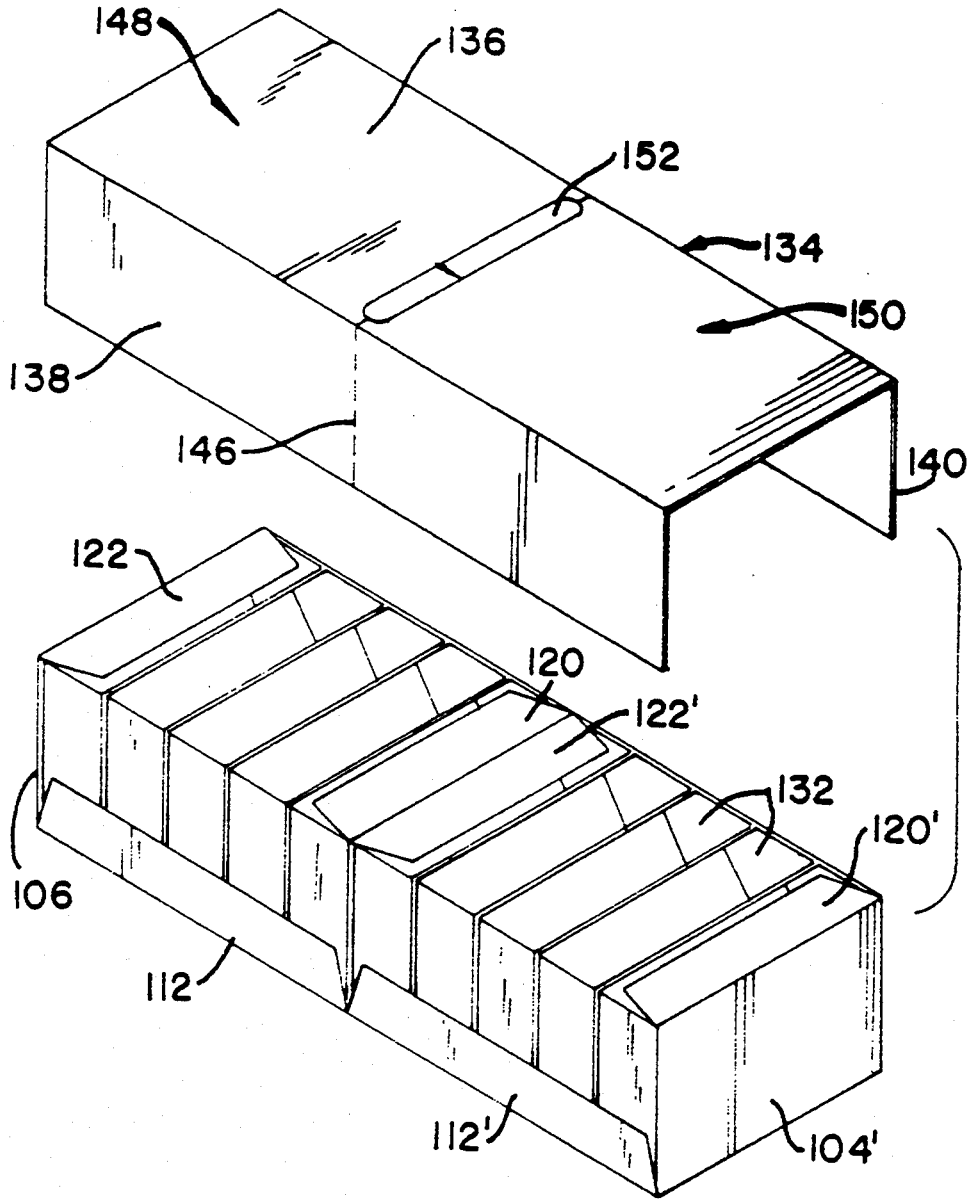
FIG. 6 is a perspective view of the unassembled relationship of the partially enclosed first and second members with the third member when folded into a U-shaped profile for assembly into a filled cigarette carton in accordance with the present invention.

Referring to FIG. 6, the assembly of sheet 134 with the partially enclosed first and second members 128, 128' will now be described in completing the construction of a separable container in accordance with one embodiment of a separable container in accordance with one embodiment of the present invention. The sheet 134 is formed in a U-shaped member by folding the front wall 138 and rear wall 140 downwardly about their respective fold lines 142, 144. Sheet 134, as formed into a U-shaped member, is positioned about the partially enclosed first and second members 128, 128' and secured thereto by means of a suitable adhesive. More specifically, the end flaps 120, 122 of the partially enclosed first members 128 and the end flaps 120', 122' of the partially enclosed second member 128' are adhesively bonded to the inside surface of the top wall 136 formed from sheet 134. In a like manner, the side flaps 112 of the partially enclosed first member 128 and side flaps 112' of the partially enclosed second member 128' are adhesively bonded to the inside surface of the front wall 138, while side flaps 114, '114 are bonded to the inside surface of and rear wall 140 formed from sheet 134.

Figure 7:
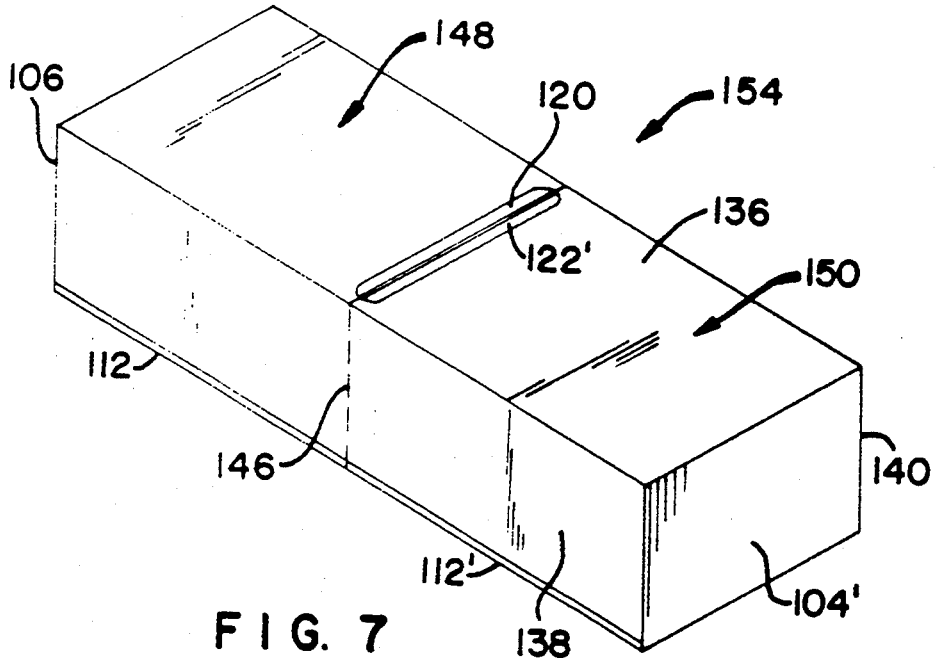
FIG. 7 is a perspective view of an assembled cigarette carton in accordance with the present invention having the third member secured to the partially enclosed first and second members to provide first and second walled enclosures each for storing a plurality of cigarette packs.

The resulting assembled separable container 154 for storing a plurality of cigarette packs 132 is shown in FIG. 7. It is contemplated that the front wall 138 or rear wall 140 formed from sheet 134 may be temporarily tacked using a fugitive adhesive in a closed position to the side flaps 112, 112' and 114, 114' such that the container 154 when used for cigarette packs 132, may be case packed, shipped and then reopened by the distributor whereby tax stamps or tax decals can be added to the ends of the cigarette packs upon opening of the temporarily tacked front wall or rear wall. The container 154 can then be sealed closed using a more permanent bonding adhesive.

Figure 8:
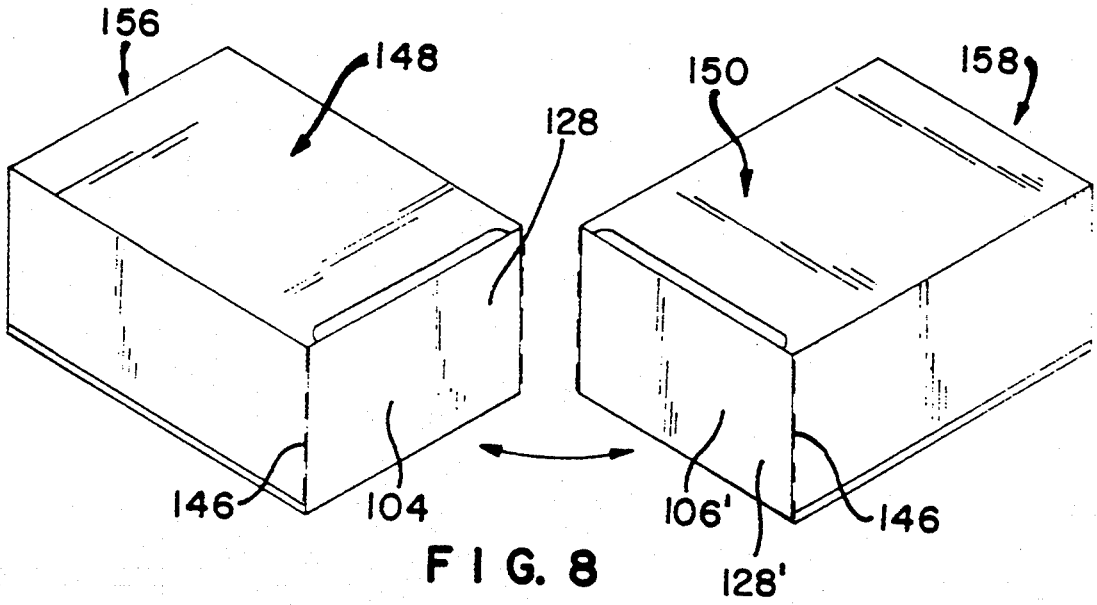
FIG. 8 is a perspective view of the cigarette carton having been separated into two individual cartons for respective storage of less than the total quantity of a cigarette packs in accordance with the present invention.

Referring to FIG. 8, the container 154 has been separated into individual cigarette cartons 156, 158 formed from the partially enclosed first and second members 128, 128' and upper and lower sections 148, 150 of sheet 134. This has been achieved by separating the sheet 134 along the perforated line 146 thereby dividing the container into the individual cigarette cartons 156, 158. In this regard, the partially enclosed first and second members 128, 128' each form the bottom wall and spaced apart end walls of the individual cigarette cartons 156, 158. On the other hand, sheet 134 forms the top wall, front wall and rear wall of the individual cigarette cartons 156, 158.

As additionally shown in the figures, the sheet 134 is provided with an elongated opening 152 interrupting the line of perforations 146 within the top wall 136 of the sheet 134. The opening 152 facilitates separating the sheet 134 into the two sections 148, 150 by weakening the perforated line 146. It is also contemplated that other shapes for the opening 152 may be employed, such as a plurality of circles, a slit and the like.

Figure 9:
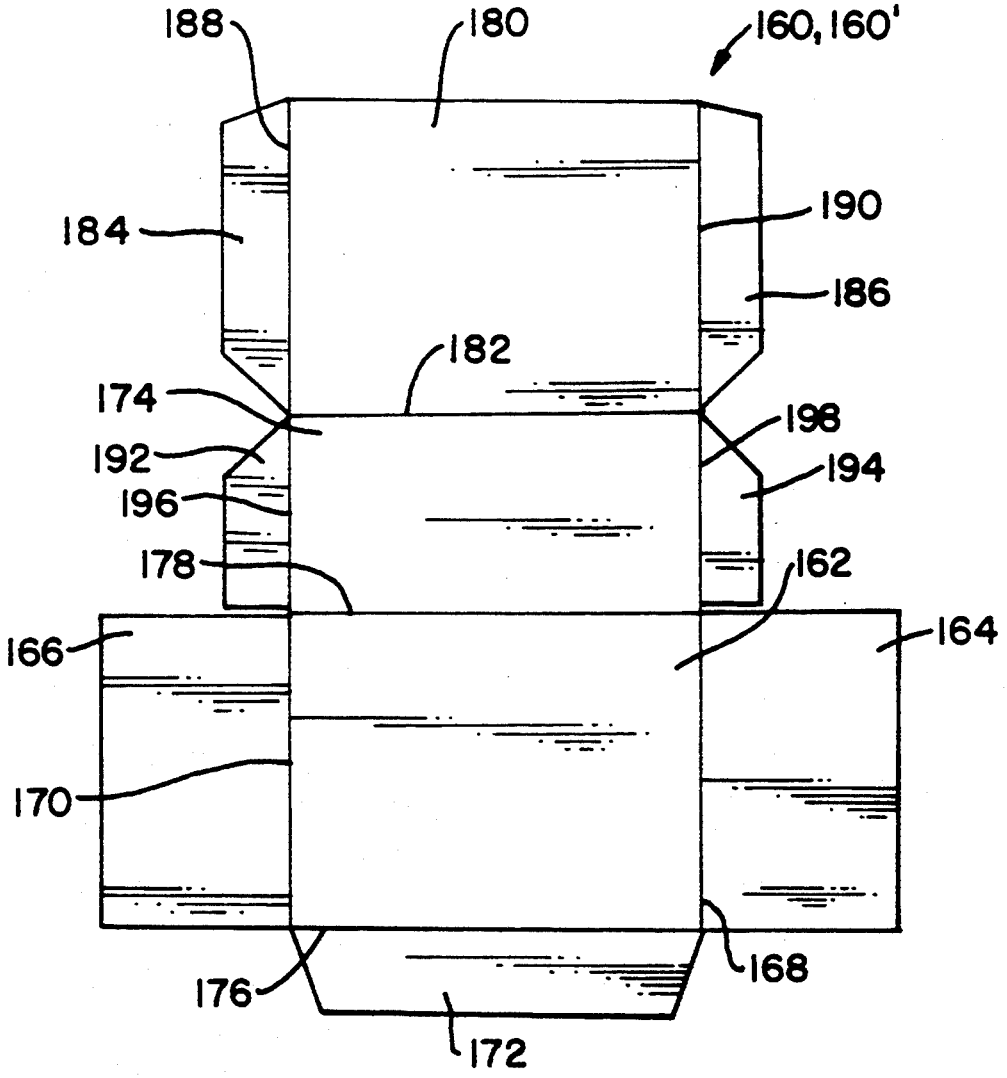
FIG. 9 is a top plan view of a sheet of substantially rigid or semi-rigid, self-supporting material being die cut and provided with fold lines for forming alternate partially enclosed members in accordance with the present invention.

Referring to FIG. 9, an alternate sheet 160 or 160' to be formed into a partially enclosed member for receiving a plurality of cigarette packs 132 is shown. The sheet 160 includes a bottom wall 162 and a pair of spaced apart end walls 164, 166. The end walls 164, 166 are integrally joined on either side of the bottom wall 162 by means of a pair of parallel spaced fold lines 168, 170. The sheet 160 includes a side glue flap 172 integrally joined to one side of the bottom wall 162 along fold line 176. Side panel or wall 174 is integrally joined to the remaining side of the bottom wall 162 by means of a fold line 178. Top panel or wall 180 is integrally joined to the side panel 174 by means of fold line 182. Glue flaps 184, 186 are integrally joined to each side of the top wall 180 by means of parallel spaced fold lines 188 and 190, respectively. Glue flaps 192 and 194 are integrally joined to the side wall 174 by means of parallel spaced fold lines 196 and 198, respectively.

Figure 10:
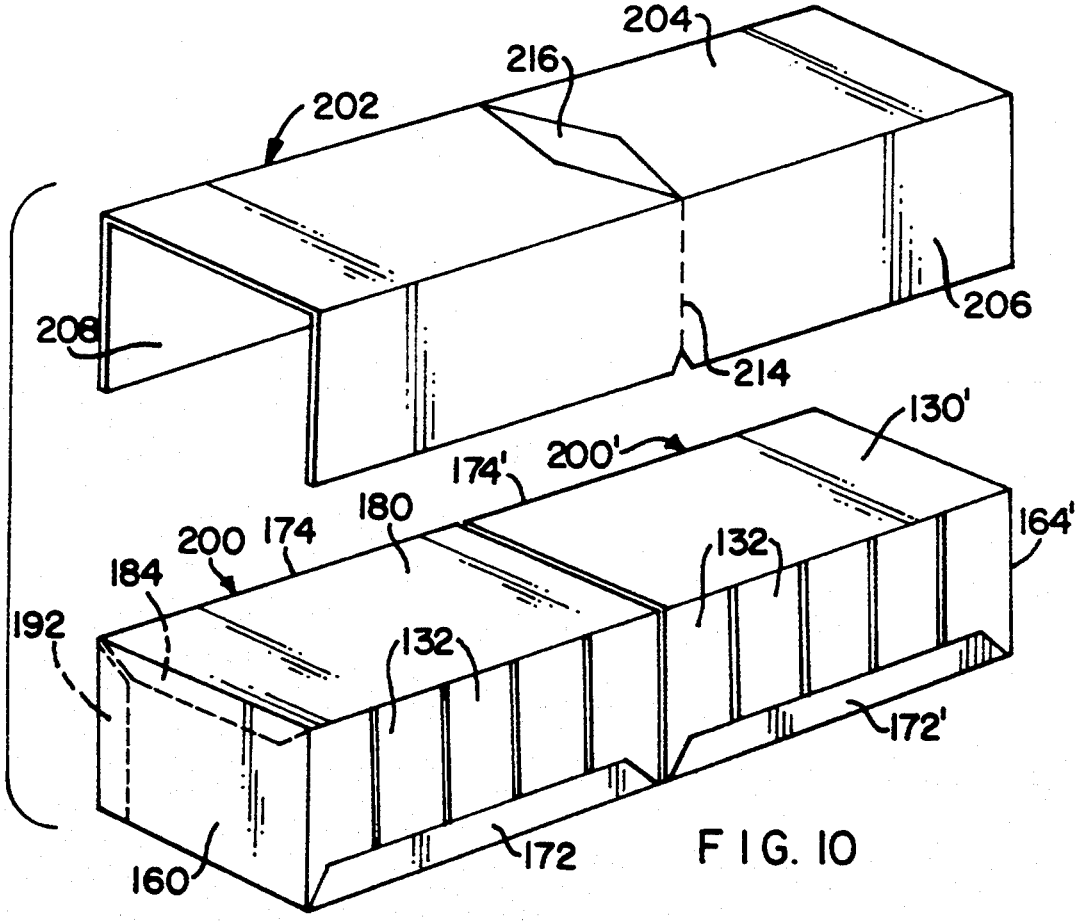
FIG. 10 is a perspective view of the relationship of partially enclosed first and second members formed from the sheet of FIG. 9 with an alternate third member which is folded into a U-shaped profile for assembly into a filled cigarette carton in accordance with the present invention.

The sheet 160, as shown in FIG. 10, is formed into a partially enclosed first container 200 for cigarette packs 132 by adhering the outer surfaces of glue flaps 184 and 192 to the inner surface of end wall 166; and by adhering the outer surfaces of glue flaps 185 and 194 to the inner surface of end wall 164. A partially enclosed second container 200' is similarly prepared from a sheet 160' and arranged adjacent the first container 200 in end-to-end relationship for receiving a plurality of cigarette packs 132.

Figure 11:
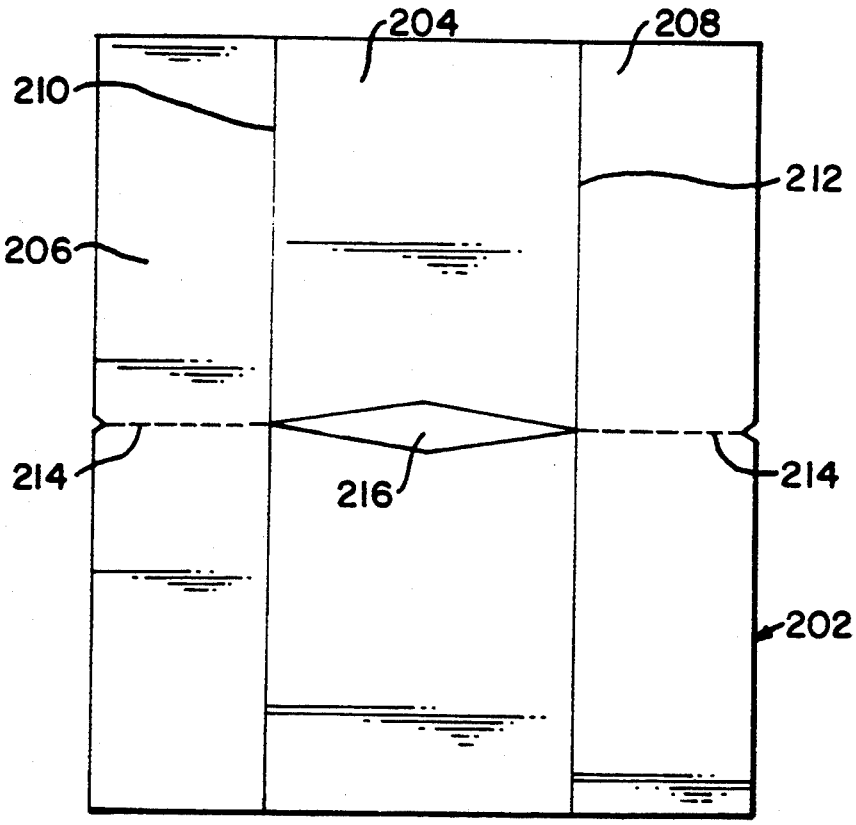
FIG. 11 is a top plan view of a sheet of substantially rigid or semi-rigid, self-supporting material being die cut and provided with fold lines for forming the alternate third member in accordance with the present invention.

The cigarette container is completed using a unitary sheet 202 as shown in FIG. 11, which is similar in construction to the unitary sheet 134 shown in FIG. 5. The unitary sheet 202 is constructed of substantially rigid or semi-rigid, self-supporting material, such as stiff paper, cardboard-like material and the like having a generally rectangular shape. The sheet 202 is divided into three panels which form a top wall 204 and spaced apart front and rear walls 208, 206, respectively, when assembled with the partially enclosed first and second containers 200, 200'. The front and rear walls 208, 206 are integrally joined to the top wall 216 by means of a pair of parallel spaced apart fold lines. A line of perforations 214 is formed transversely across the sheet 202 so as to divide the top wall 204, front wall 208 and rear wall 206 into two sections which may be of equal size and symmetrical with each other as shown in accordance with one embodiment. The perforations 214 may optionally be interrupted within, for example, the top wall 204 by means of a diamond or other shaped opening 216 for the purposes as previously described.

The sheet 202 is positioned over the two adjacent partially enclosed containers 200, 200' so as to be fixedly secured thereto. In particular, permanent bonding adhesive is employed to secure the inner surface of front wall 208 of sheet 202 to the outer surface of side wall 174 of sheets 160, 160' as well as the inner surface of top wall 204 of sheet 202 to the outer surface of top wall 180 of sheets 160, 160'. As such, rear wall 206 of sheet 202 can act in combination with glue flaps 172, 172' of sheets 160, 160' to seal the carton assembly shut, e.g., by applying a hot melt or "tack" adhesive to the outer surface of the glue flaps and the inner surface of rear wall 208.

The present invention has thus far been described as a container separable into individual containers of smaller but equal size for each storing a plurality of articles such as cigarette packs 132 and the like. In the preferred aspect, the container is separable into two individual half containers or cartons, each half carton containing five cigarette packs 132. However, it is contemplated that the container 154 may be separated into unequal sized individual containers by providing the partially enclosed first and second members 128, 128' of unequal size and positioning the perforated line 146 at an appropriate proportional position within the sheet 134. Thus, a single row of ten cigarette packs 132 may be divided unequally, for example, four packs and six packs, three packs and seven packs and the like. In addition, the cigarette packs 132 may be arranged in other than a single row, for example, in a double row of, for example, two by six, two by four or the like. This enables the container 154 to be separated into cigarette cartons containing six or four packs each when separated equally. In addition, it is also contemplated that more than two partially enclosed first and second members 128, 128' may be provided within a single container 154 thereby enabling the separation of the container into multiple individual containers of the same or different size and the like as desired. Accordingly, it can be appreciated that the separable container of the present invention is versatile in meeting the very needs of the retailer in selling less than a full carton of cigarette packs or other such articles as previously required by known cigarette cartons.

Although the invention herein has been described with references to particular embodiments, it is to be understood that the embodiments are merely illustrative of the principles and application of the present invention. It is therefore to be understood that numerous modifications may be made to the embodiments and that other arrangements may be devised without departing from the spirit and scope of the present invention as defined by the claims.

What is claimed is:

1. A container for storing a plurality of articles, said container comprising first and second members arranged in adjacent relationship, each of said first and second members including a configuration of only a portion of a carton and having a partially open top in combination with a partially open rear and a partially open front, and a third member secured to said first and second members overlying said partially open top, and said partially open rear and said partially open front, said third member forming with said first member a first walled enclosure and forming with said second member a second walled enclosure each for storing a plurality of articles, said first and second walled enclosures each including a bottom wall, a top wall, a pair of spaced apart end walls, a front wall and a rear wall, said bottom wall and said pair of spaced apart end walls formed by said first and second members, a portion of said front wall and said rear wall formed by said third member, wherein at least one of said partially open front and said partially open rear of said first and second members comprises a flap extending from said bottom wall and which is unconnected to said spaced apart end walls and separating means in association with said third member for separating said first walled enclosure from said second walled enclosure.

2. The container of claim 1, wherein said separating means comprises a plurality of perforations.

3. The container of claim 1, wherein said first walled enclosure and said second walled enclosure are of substantially equal size.

4. The container of claim 1, wherein said first, second and third members are constructed of separate blanks of substantially rigid or semi-rigid, self-supporting material.

5. The container of claim 1, wherein said container comprises a cigarette carton for storing said plurality of articles comprising cigarettes arranged in a plurality of packs.

6. The container of claim 1, wherein said third member has a U-shaped profile.

7. A cigarette carton for storing a plurality of cigarette packs, said carton comprising first and second members arranged in adjacent relationship, each of said first and second members including a configuration of only a portion of a carton and having a partially open top in combination with a partially open rear and a partially open front, and a third member secured to said first and second members overlying said partially open top, and said partially open rear and said partially open front, said third member forming with said first member a first walled enclosure and forming with said second member a second walled enclosure each for storing a plurality of cigarette packs, said first and second members forming bottom walls and spaced apart end walls of said first and second walled enclosures, said third member forming top walls, a portion of front walls and rear walls of said first and second walled enclosures, wherein at least one of said partially open front and said partially open rear of said first and second members comprises a flap extending from said bottom wall and which is unconnected to said spaced apart end walls and separating means in association with said third member for separating said first walled enclosure from said second walled enclosure.

8. The carton of claim 7, wherein said separating means comprises a plurality of perforations.

9. The carton of claim 7, wherein said first walled enclosure and said second walled enclosure are of substantially equal size.

10. The carton of claim 7, wherein said first, second and third members are constructed of separate blanks of substantially rigid or semi-rigid, self-supporting material.

11. The carton of claim 7, wherein said third member has a U-shaped profile.

* * * * *